US010902732B2

(12) United States Patent
Srinivasan et al.

(10) Patent No.: US 10,902,732 B2
(45) Date of Patent: Jan. 26, 2021

(54) METHOD AND SYSTEM FOR MONITORING EXECUTION OF CONDITIONAL AIR TRAFFIC CONTROL CLEARANCES FOR AN AIRCRAFT

(71) Applicant: HONEYWELL INTERNATIONAL INC., Morris Plains, NJ (US)

(72) Inventors: Narayanan Srinivasan, Tamil Nadu (IN); Gobinathan Baladhandapani, Tamil Nadu (IN); Hariharan Saptharishi, Tamil Nadu (IN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 361 days.

(21) Appl. No.: 15/874,434

(22) Filed: Jan. 18, 2018

(65) Prior Publication Data

US 2019/0221126 A1 Jul. 18, 2019

(51) Int. Cl.
*G08G 5/00* (2006.01)
*G08G 5/06* (2006.01)

(52) U.S. Cl.
CPC ..... *G08G 5/0013* (2013.01); *G08G 5/0021* (2013.01); *G08G 5/0078* (2013.01); *G08G 5/065* (2013.01)

(58) Field of Classification Search
CPC .. G08G 5/0013; G08G 5/0021; G08G 5/0078; G08G 5/06; G08G 5/065
See application file for complete search history.

(56) References Cited

U.S. PATENT DOCUMENTS

| | | | | |
|---|---|---|---|---|
| 6,160,497 | A | 12/2000 | Clark | |
| 6,828,921 | B2 | 12/2004 | Brown et al. | |
| 8,229,604 | B2 | 7/2012 | Villaume et al. | |
| 8,386,167 | B2 | 2/2013 | Clark et al. | |
| 8,704,701 | B2 | 4/2014 | Pschiere et al. | |
| 9,508,262 | B2 | 11/2016 | Kar et al. | |
| 2003/0193408 | A1* | 10/2003 | Brown | G08G 5/0086 340/945 |
| 2005/0203676 | A1* | 9/2005 | Sandell | G08G 5/0013 701/3 |
| 2015/0239574 | A1* | 8/2015 | Ball | B64D 45/00 701/3 |
| 2016/0155337 | A1 | 6/2016 | Krishna et al. | |

(Continued)

FOREIGN PATENT DOCUMENTS

EP 2779139 A1 9/2014

*Primary Examiner* — Peter D Nolan
*Assistant Examiner* — Demetra R Smith-Stewart
(74) *Attorney, Agent, or Firm* — Lorenz & Kopf, LLP

(57) ABSTRACT

Methods and apparatus are provided for monitoring execution of air traffic control (ATC) conditional clearances for a user aircraft. The method monitors ATC clearances transmitted to all other aircraft across each communication channel from an airport. Every other aircraft is identified and the relevant data each ATC clearance is transcribed. A dependency table is generated for the user aircraft with the relevant data from every other aircraft. The dependency table identifies each relevant clearance that must be completed by all other aircraft before the user aircraft executes a conditional ATC clearance. The status of all relevant dependent ATC clearances is monitored and the user aircraft is informed of its conditional ATC clearance upon completion of the relevant dependent ATC clearances.

20 Claims, 7 Drawing Sheets

(56) References Cited

U.S. PATENT DOCUMENTS

| | | | | |
|---|---|---|---|---|
| 2016/0161283 | A1 | 6/2016 | Shamasundar et al. | |
| 2017/0069213 | A1* | 3/2017 | Thomas | H04W 4/14 |
| 2017/0221369 | A1 | 8/2017 | Bilek et al. | |
| 2018/0277116 | A1* | 9/2018 | Shamasundar | B64D 43/00 |

* cited by examiner

METHOD AND SYSTEM FOR MONITORING EXECUTION OF CONDITIONAL AIR TRAFFIC CONTROL CLEARANCES FOR AN AIRCRAFT

TECHNICAL FIELD

The present invention generally relates to aircraft operations, and more particularly relates to a method and system for monitoring execution of conditional air traffic control (ATC) clearances for an aircraft.

BACKGROUND

Air traffic controllers (ATC) are responsible for organizing and expediting aircraft traffic in a controlled airspace and on the ground by issuing instructions and clearances to pilots of aircraft. To streamline operations of multiple aircraft, ATC may issue a "conditional clearance" where the pilot is cleared to act when the condition occurs. However, misunderstanding, ambiguity or other confusion may exist for conditional clearance. Hence, there is a need for a method and system for a contextual monitoring execution of ATC conditional clearances for an aircraft.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

A method is provided for monitoring execution of conditional air traffic control (ATC) clearances for a user aircraft. The method comprises: monitoring ATC clearances transmitted to all subject aircraft across each communication channel from an airport; identifying the subject aircraft for each ATC clearance; transcribing relevant data from each ATC clearance; generating a dependency table for the user aircraft with the relevant data from each subject aircraft, where the dependency table identifies each dependent ATC clearance that must be completed by all subject aircraft before the user aircraft executes a conditional ATC clearance; monitoring the status of all subject aircraft with respect to the completion of dependent ATC clearances; and informing the user aircraft of the conditional ATC clearance upon completion of all dependent ATC clearances by all subject aircraft.

An apparatus is provided for monitoring execution of conditional air traffic control (ATC) clearances for a user aircraft. The apparatus comprises: a communications receiver that monitors ATC clearances for all subject aircraft across each communications channel for an airport and monitors the status of all subject aircraft with respect to the completion of each respective ATC clearance; a central processor located on board the aircraft that receives the ATC clearances from the communications receiver and, identifies the subject aircraft for each ATC clearance, transcribes the relevant data for each ATC clearance, generates a dependency table for the user aircraft with the relevant data from each subject aircraft, where the dependency table identifies each dependent ATC clearance that must be completed by all subject aircraft before the user aircraft exectues a conditional ATC clearance, and generates a notification for the user aircraft of the completion of all dependent ATC clearances by all subject aircraft; and a display device that receives the notification of the completion of all dependent ATC clearances by all subject aircraft, where the display device informs the user aircraft of the conditional ATC clearance.

Furthermore, other desirable features and characteristics of the method and system will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

A method for monitoring execution of conditional air traffic control (ATC) clearances for user aircraft has been developed. ATC clearances are monitored as they are transmitted to all subject aircraft across each communication channel from an airport. The subject aircraft are identified and each ATC clearance is transcribed for relevant data for its subject aircraft. A dependency table is generated for the user aircraft using the relevant data for each subject aircraft. The dependency table identifies each dependent ATC clearance that must be completed by all subject aircraft before the user aircraft executes its conditional ATC clearance. The status of all the relevant subject aircraft is monitored for completion of their respective dependent ATC clearances. When these clearances are completed, the user aircraft is informed of permission to execute its conditional ATC clearance.

Figure 1:
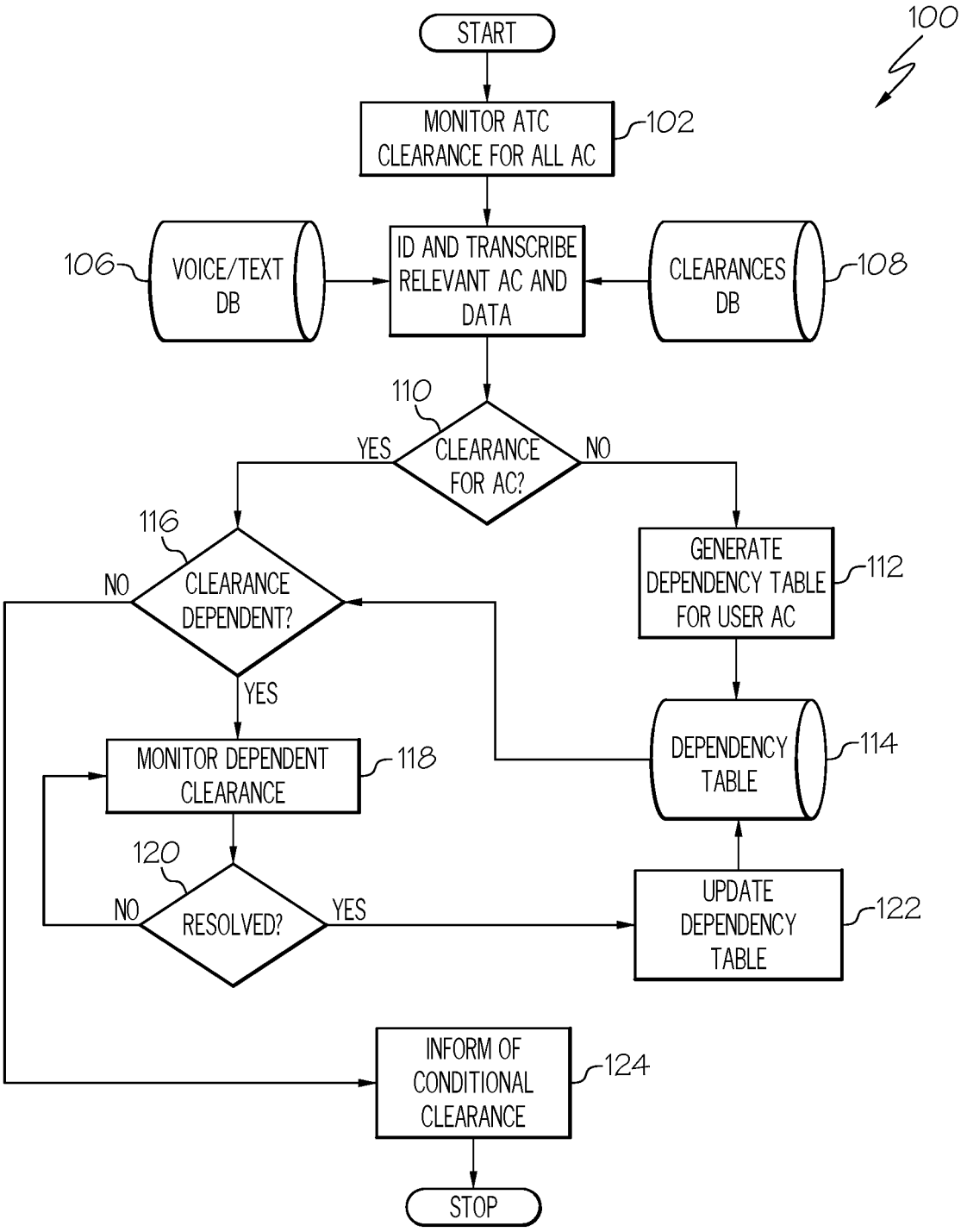
FIG. 1 shows a flowchart of a method of monitoring execution of ATC conditional clearances for a user aircraft in accordance with one embodiment.

Turning now to FIG. 1, a flowchart 100 is shown of a method for monitoring execution of conditional ATC clearances for user aircraft. First, ATC clearances for all subject aircraft are monitored across each communication channel used at an airport 102. Each subject aircraft is identified and relevant data from its corresponding ATC clearance is transcribed 104 into a textual format. Typically, each subject aircraft is identified by an aircraft call sign. The relevant data from the ATC clearances may be received in either voice or data formats. In some embodiments, the data format may comprise a text message. In other embodiments, the data may be transmitted utilizing a Controller-Pilot Datalink Communication (CPDLC) protocol or a digital taxi system.

The transmitted ATC clearances received in a voice message are transcribed into a text format and stored in an electronic database 106. The transcribed ATC clearances are matched with an appropriate clearance command retrieved from an electronic clearance database 108. Both the transcribed clearances along with clearances received in a text format, are analyzed for their relevance to the present user aircraft by using the call sign and contextual information of the user aircraft. Non-relevant ATC clearances are typically ignored since they have no impact on operations of the user aircraft.

Next, each ATC clearance is analyzed to determine if it is directed towards the user aircraft 110. If the clearance is not directed to the user aircraft, a dependency table for the user aircraft is generated 112. The dependency table identifies each dependent ATC clearance that is "relevant". A relevant clearance is a clearance that must be completed by the corresponding subject aircraft before the user aircraft executes a conditional ATC clearance. Therefore, permission to execute the conditional ATC clearance is "dependent" upon completion of the dependent ATC clearance by the subject aircraft. The dependency table lists all dependent ATC clearances in order and it is stored in an electronic database 114.

Once the user aircraft receives a conditional ATC clearance, the dependency table is consulted to determine if the conditional ATC clearance is dependent upon the completion of a dependent ATC clearance by a subject aircraft 116. If the conditional ATC clearance is dependent, the dependency table is retrieved and the dependent ATC clearances are monitored for completion 118. Completion is determined by monitoring the status of the subject aircraft which may include information such as: the ground location of the subject aircraft; the altitude of the subject aircraft; the speed of the subject aircraft; and other relevant data regarding the subject aircraft.

As each dependent ATC clearance is resolved 120, the dependency table is updated with the specific ATC dependent clearance being removed from the dependency table as it is completed 122. The dependency table is continually monitored until all dependent ATC clearances are cleared. Once the conditional ATC clearance for the user aircraft no longer has any uncleared dependent ATC clearances, the user aircraft is informed of permission to execute its conditional ATC clearance. In various embodiments, the conditional ATC clearance may include permission for the user aircraft to perform: a final approach; a landing, taxiing; departure; runway crossing; push back from gate; and any other similar operations for the user aircraft.

Figure 2:
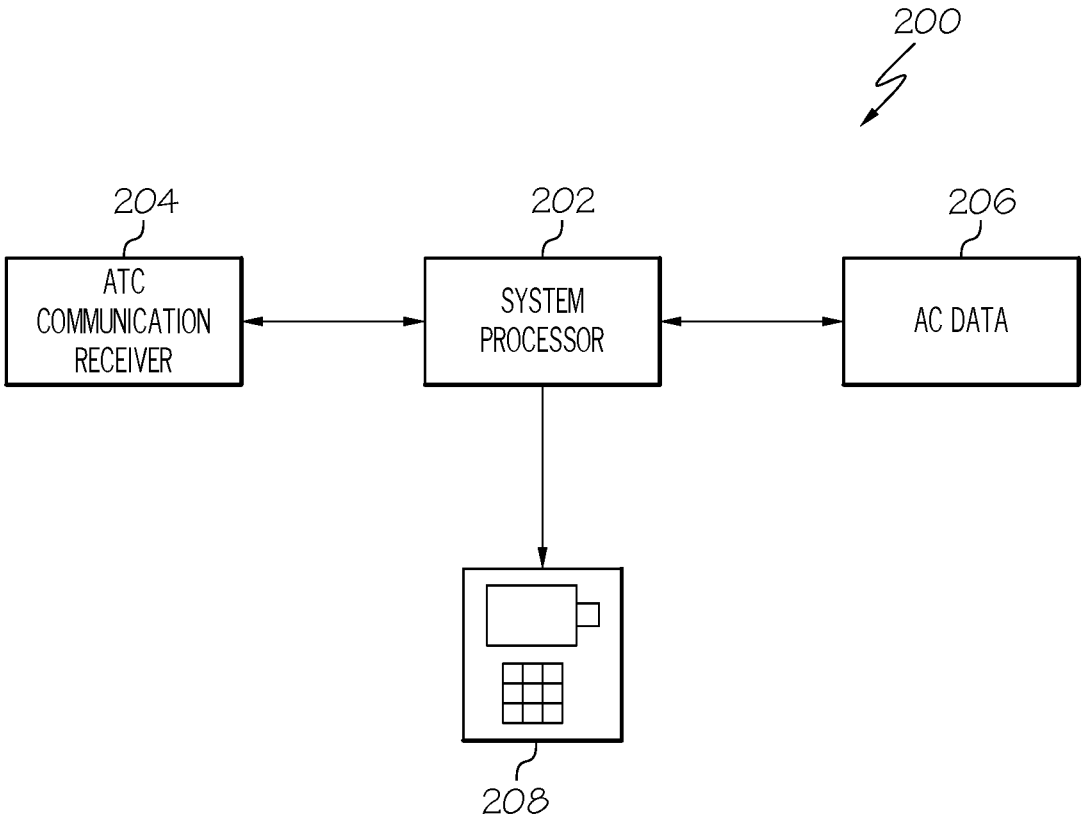
FIG. 2 shows a block diagram of a system of monitoring execution of ATC conditional clearances for a user aircraft in accordance with one embodiment.

Turning now to FIG. 2, a block diagram 200 is shown of a system for monitoring of conditional ATC clearances for a user aircraft in accordance with some embodiments. The system includes a communications receiver 204 that continually monitors ATC clearances for all subject aircraft across each communications channel for an airport. The receiver also continually monitors the status of all subject aircraft with respect to the completion of each respective ATC clearance. The communications receiver 204 monitors both the voice and data communications. In some embodiments, the data communications are received via a Controller-Pilot Datalink Communication (CPDLC) protocol. Additionally, a voice to text translation capability may be included in the communications receiver 204 or alternatively within the system processor 202 in some embodiments.

A central system processor 202 located on board the aircraft receives the ATC clearances from the communications receiver. The processor identifies the subject aircraft for each ATC clearance and transcribes the relevant data from the respective clearance. The relevant data is used to generate a dependency table for the user aircraft with relevant data from each subject aircraft. The dependency table identifies each dependent ATC clearance that must be completed before the user aircraft executes a conditional ATC clearance. Once all dependent ATC clearances have been completed, the processor generates a notification for the user aircraft. A display device 208 on board the aircraft receives the notification from the system processor 202. The display device 208 informs the user aircraft of permission to execute its conditional ATC clearance. In some embodiments, the display device may be a multi-function display (MFD) unit.

Figure 3:
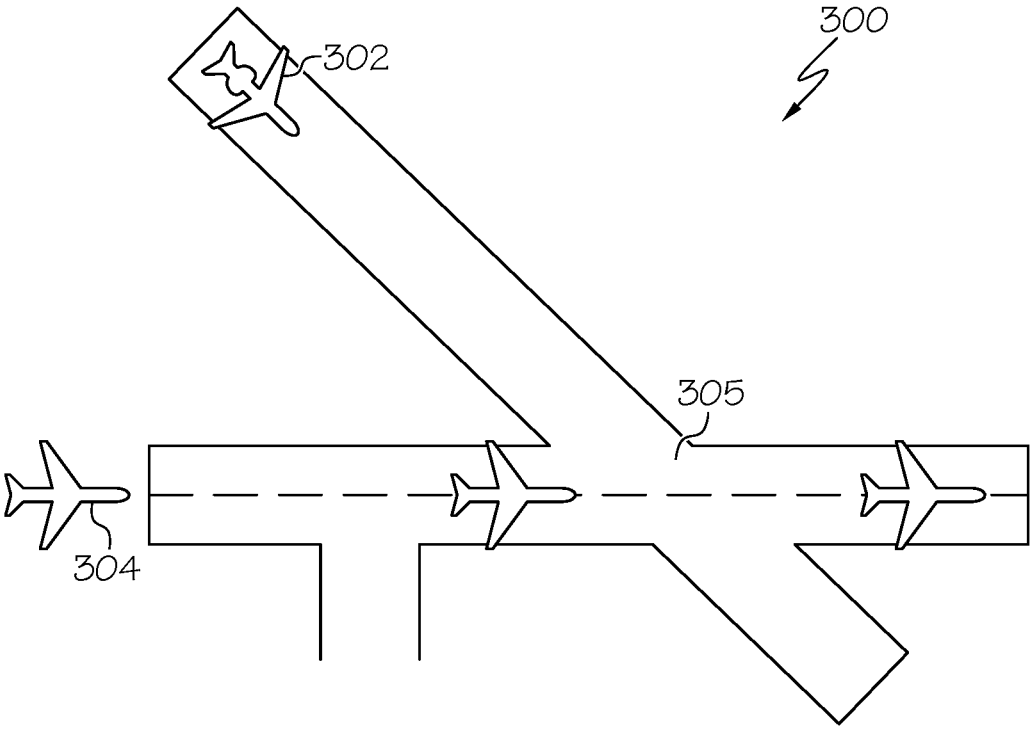
FIG. 3 shows a diagram of an example of ATC conditional clearances for taxiing of a user aircraft in accordance with one embodiment.

Turning now to FIG. 3, a diagram 300 is shown of an example of conditional ATC clearances for taxiing operations of a user aircraft in accordance with one embodiment. In this example, the user aircraft 302 has a conditional ATC clearance to pass through a taxiway intersection 305. However, a subject aircraft 304 has a dependent ATC clearance to pass through the same intersection 305 before the user aircraft 302. The progress of the subject aircraft 304 is monitored until it is through the intersection 305. At this point, the dependent ATC clearance for the subject aircraft 306 is completed. The user aircraft 302 is now given permission to proceed with its conditional ATC clearance and pass through the intersection 305.

Figure 4:
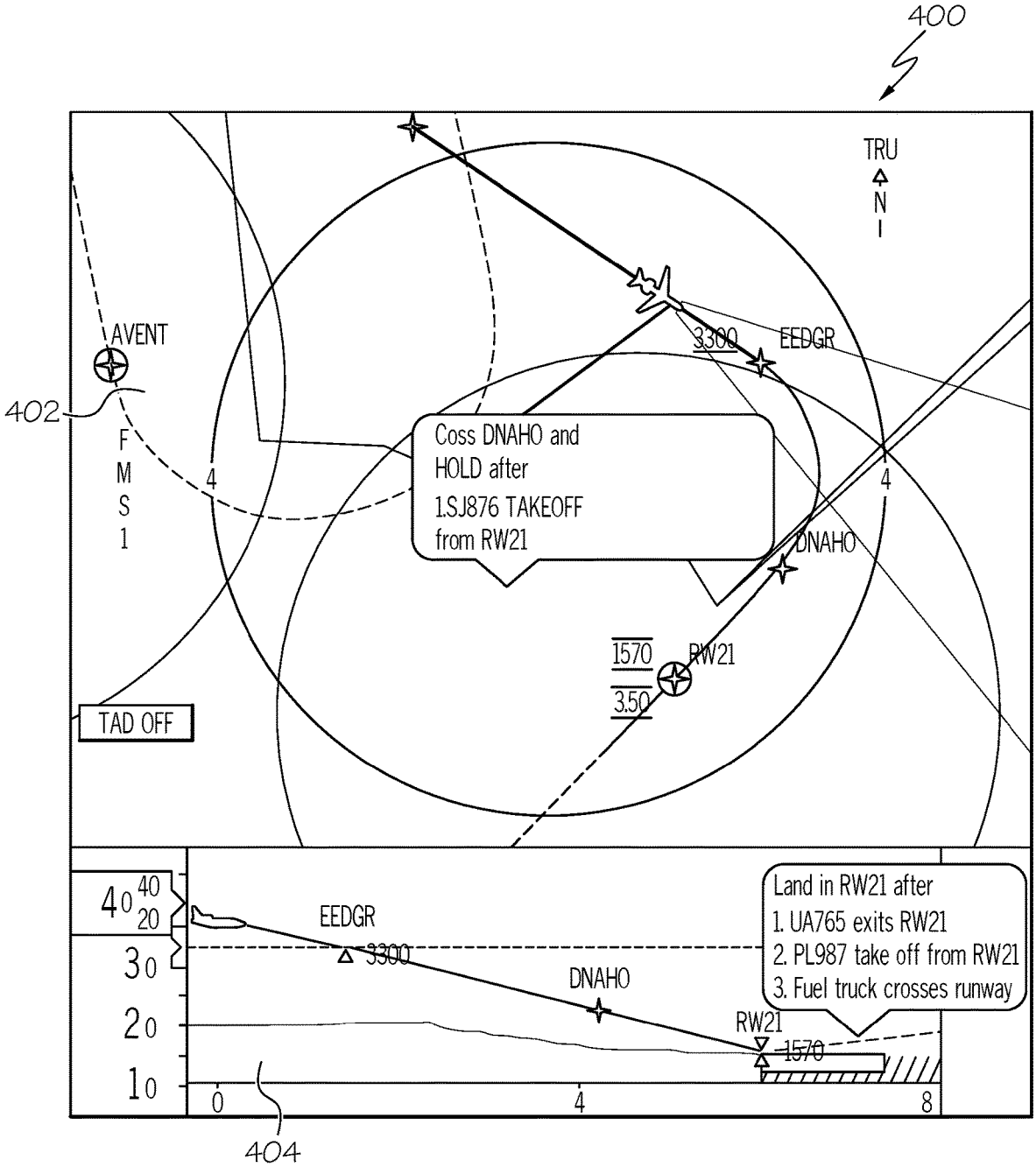
FIG. 4 shows examples of an electronic display of ATC conditional clearances for final approach of a user aircraft in accordance with one embodiment.

Turning now to FIG. 4, electronic displays 400 are shown of examples of conditional ATC clearances for final approach and landing of a user aircraft in accordance with one embodiment. In the overhead display 402, the user aircraft is given the conditional ATC clearance of "Cross DNAHO and Hold" along with the dependent ATC clearance of "SJ876 Take Off from RW21". These clearances instruct the user aircraft to cross waypoint DNAHO and take up a holding pattern after a subject aircraft with the call sign SJ876 completes its take off from Runway 21. In the vertical situation display 404, the user aircraft is given the conditional ATC clearance of "Land in RW21" along with 3 separate dependent ATC clearances. The dependent ATC clearances are in order of completion: "UA765 Exits RW21"; "PL987 Take Off from RW21"; and "Fuel Truck Crosses Runway". These clearances instruct the user aircraft to land on Runway 21 after a subject aircraft with the call sign of UA765 exits the runway, a subject aircraft with the call sign of PL987 takes off from the runway, and a fuel truck crosses the runway.

Figure 5A:
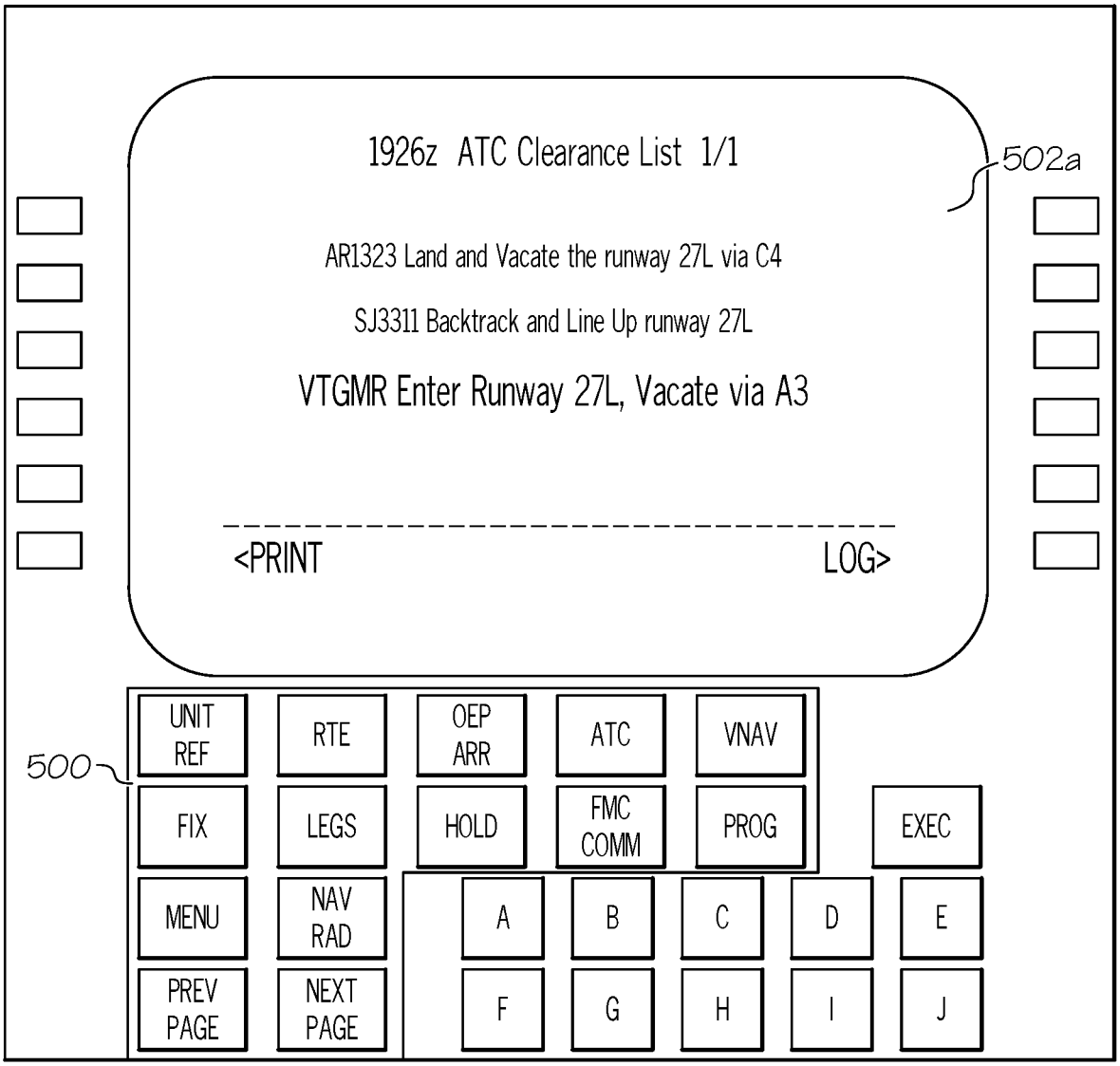
FIGS. 5*a*-5*c* show views of a multifunction display (MFD) showing dependent ATC clearances in accordance with one embodiment.
Figure 5B:
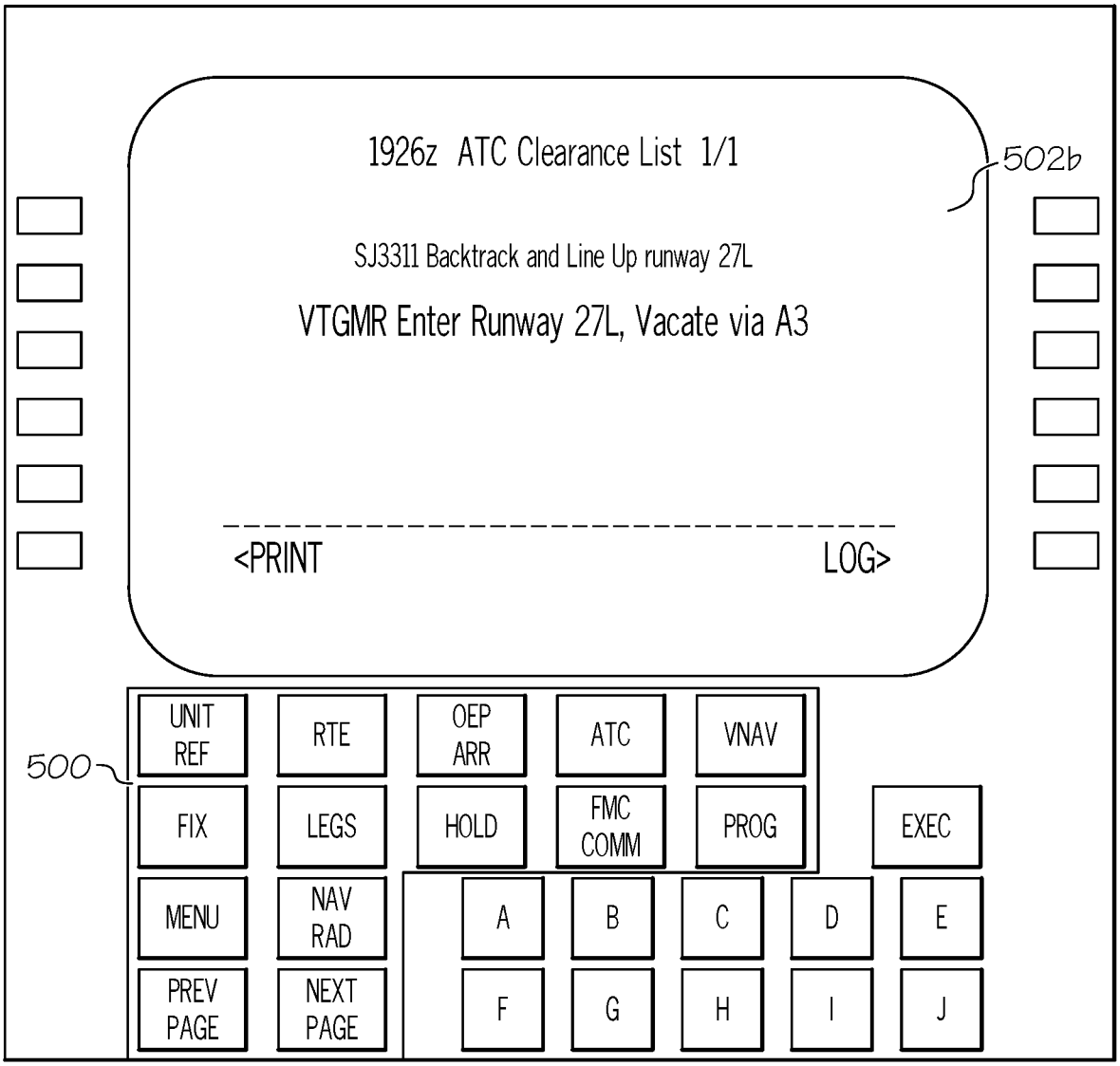
Figure 5C:
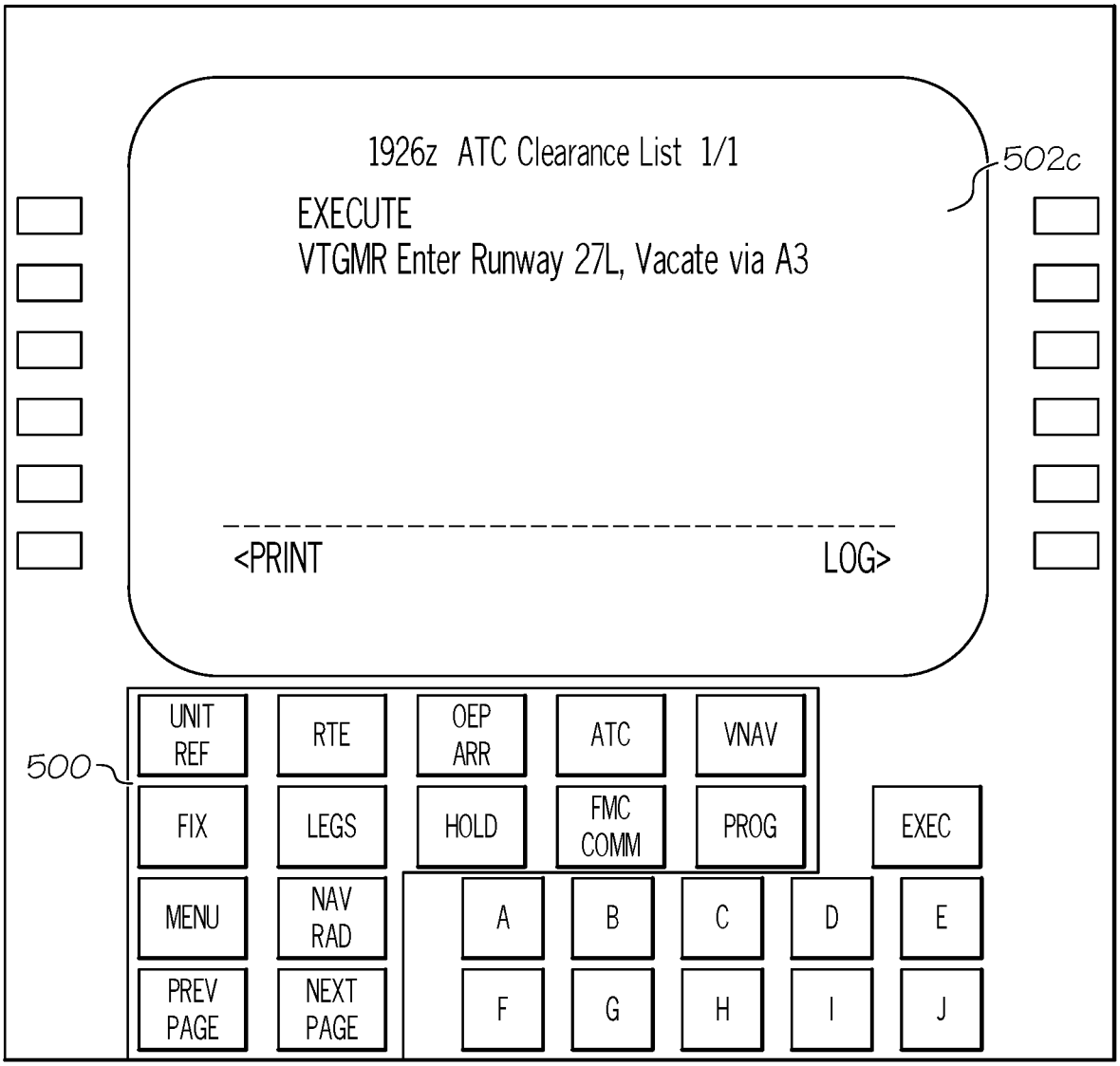

Turning now to FIGS. 5*a*-5*c*, multiple views 500 are shown of a multi-function display (MFD) dependent and conditional ATC clearances for a user aircraft in accordance with one embodiment. In the initial display 502*a*, two separate dependent ATC clearances are shown ahead of a conditional ATC clearance for the user aircraft. As the first dependent ATC clearance is completed, it is removed from the display 502*b*. Once the second dependent ATC clearance is completed, it is also removed from the display 502*c* and the "Execute" command is shown for the conditional ATC clearance. In this manner, the aircrew can track the progress of dependent ATC clearances in preparation for execution of the conditional ATC clearance of their aircraft. This display helps prevent any misunderstanding, ambiguity or other confusion may exist from manually tracking dependent and conditional clearances.

Those of skill in the art will appreciate that the various illustrative logical blocks, modules, circuits, and algorithm steps described in-connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method of monitoring execution of conditional air traffic control (ATC) clearances for a user aircraft, comprising:

monitoring ATC clearances transmitted to all subject aircraft across each communication channel from an airport with a communications receiver onboard the user aircraft, where subject aircraft comprise individual aircraft in an ATC controlled traffic pattern with the user aircraft;

identifying the subject aircraft for each ATC clearance with the communications receiver;

transcribing relevant data from each ATC clearance with the communications receiver;

generating a dependency table for the user aircraft with the relevant data from each subject aircraft, where the dependency table identifies each dependent ATC clearance that must be completed by all subject aircraft before the user aircraft executes a conditional ATC clearance with a central processor located on board the user aircraft;

monitoring the status of all subject aircraft with respect to the completion of dependent ATC clearances with the communications receiver; and informing the user aircraft of the conditional ATC clearance upon completion of all dependent ATC clearances by all subject aircraft with a graphical display device on board the aircraft.

2. The method of claim 1, where identifying the subject aircraft is done with an aircraft call sign.

3. The method of claim 1, where the relevant data is transcribed from a voice communication.

4. The method of claim 1, where the relevant data is transcribed from a data communication.

5. The method of claim 4, where the data communication comprises a text message.

6. The method of claim 4, where the data communication uses a Controller-Pilot Datalink Communication (CPDLC) protocol.

7. The method of claim 1, where the relevant data comprises a dependent ATC clearance.

8. The method of claim 1, where the status of the subject aircraft comprises a ground location of the subject aircraft.

9. The method of claim 1, where the status of the subject aircraft comprises an altitude of the subject aircraft.

10. The method of claim 1, where the status of the subject aircraft comprises a speed of the subject aircraft.

11. The method of claim 1, where the conditional ATC clearance for the user aircraft comprises a departure.

12. The method of claim 1, where the conditional ATC clearance for the user aircraft comprises a final approach.

13. The method of claim 1, where the conditional ATC clearance for the user aircraft comprises a landing.

14. The method of claim 1, where the conditional ATC clearance for the user aircraft comprises taxiing.

15. A system for monitoring execution of conditional air traffic control (ATC) clearances for a user aircraft, comprising:

a communications receiver configured to monitor (a.) ATC clearances for all subject aircraft across each communications channel for an airport and (b.) the status of all subject aircraft with respect to the completion of each respective ATC clearance;

a central processor located on board the aircraft, the central processor configured to receive the ATC clearances from the communications receiver and, identify the subject aircraft for each ATC clearance, where subject aircraft comprise individual aircraft in an ATC controlled traffic pattern with the user aircraft, transcribe the relevant data for each ATC clearance, generate a dependency table for the user aircraft with the relevant data from each subject aircraft, where the dependency table identifies each dependent ATC clearance that must be completed by all subject aircraft before the user aircraft executes a conditional ATC clearance, and generate a notification for the user aircraft of the completion of all dependent ATC clearances by all subject aircraft; and a display device coupled to receive the notification of the completion of all dependent ATC clearances by all subject aircraft, the display device configured to inform the user aircraft of the conditional ATC clearance.

16. The system of claim 15, where the communications receiver is configured to monitor voice communications.

17. The system of claim 15, where the communications receiver is configured to monitor data communications.

18. The system of claim 17, where the data communications are received via a Controller-Pilot Datalink Communication (CPDLC) protocol.

19. The system of claim 15, where the display device is a multi-function display (MFD) unit.

20. The system of claim 15, where the conditional ATC clearance is output through an aural alert unit.

* * * * *